US007497426B2

(12) United States Patent
Walther

(10) Patent No.: US 7,497,426 B2
(45) Date of Patent: Mar. 3, 2009

(54) DEVICE FOR GATHERING SHEETS

(75) Inventor: Andreas Walther, Stadthagen (DE)

(73) Assignee: Kolbus GmbH & Co. KG, Rahden (DE)

( * ) Notice: Subject to any disclaimer, the term of this patent is extended or adjusted under 35 U.S.C. 154(b) by 392 days.

(21) Appl. No.: 11/492,665

(22) Filed: Jul. 25, 2006

(65) Prior Publication Data

US 2007/0023991 A1 Feb. 1, 2007

(30) Foreign Application Priority Data

Jul. 28, 2005 (DE) ..... 10 2005 035 332

(51) Int. Cl.
*B65G 43/08* (2006.01)

(52) U.S. Cl. ..... 270/52.16; 270/52.14; 270/58.29

(58) Field of Classification Search ..... 271/69, 271/306, 204, 277; 270/58.23, 58.24, 58.26, 270/52.19, 52.14, 52.16, 58.29
See application file for complete search history.

(56) References Cited

U.S. PATENT DOCUMENTS

| | | | | |
|---|---|---|---|---|
| 893,510 | A * | 7/1908 | Juengst | 270/52.16 |
| 6,328,297 | B1 * | 12/2001 | Antonelli et al. | 270/52.16 |
| 6,367,794 | B1 * | 4/2002 | Godwin et al. | 270/58.26 |
| 7,232,122 | B2 * | 6/2007 | Mayer et al. | 271/4.01 |
| 2006/0097440 | A1 * | 5/2006 | Bokamper | 270/58.23 |

FOREIGN PATENT DOCUMENTS

| | | | |
|---|---|---|---|
| DE | 196 16 047 | A1 | 10/1997 |
| EP | 1 520 817 | A1 | 4/2005 |

* cited by examiner

*Primary Examiner*—Kaitlin S Joerger
(74) *Attorney, Agent, or Firm*—Alix, Yale & Ristas, LLP

(57) ABSTRACT

The invention pertains to a device for gathering sheets (3) with feeder stations (15) that are arranged in a row and consist of a magazine (20) for respectively accommodating a stack (4) of identical sheets, a separating device (50) that tilts an exposed edge region (3*b*) of the respective bottom sheet away from the stack (4) and a transport device (30) that withdraws the sheet from the stack parallel to the longitudinal direction of the edge region, and with a collecting conveyor (10) that features pushers (13) for the gathered stacks (2). In order to achieve a high processing speed, the invention proposes that the separating device (50) features at least one suction element (51) for tilting away at least one corner of the sheet (3), and that the transport device for withdrawing the sheet (3) is formed by a traction means conveyor (30) with individually actuated grippers (32) that are anchored on revolving traction means (31) within certain distances from one another and at least two of which take hold of the exposed edge region (3*b*), wherein the traction means conveyor (30) is inclined toward the collecting conveyor (10) in order to deposit the withdrawn sheet (3) on the stack (2) being formed directly in front of the pusher (13) of the collecting conveyor (10). The invention makes it possible to reliably decollate head-folded signatures if the suction element (51) is arranged on the upstream corner of the stack (4).

20 Claims, 3 Drawing Sheets

Fig 3
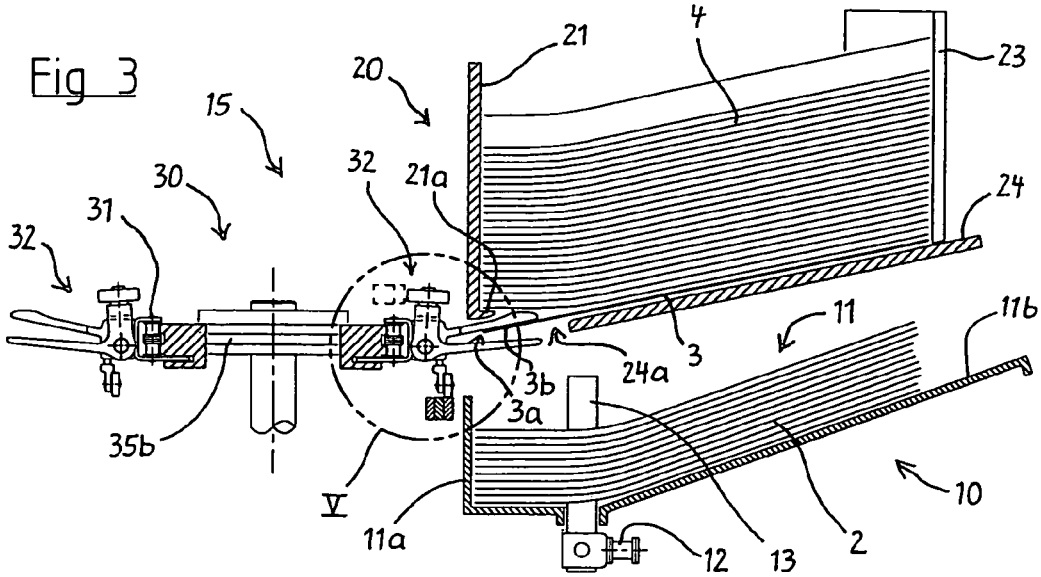
Fig 5
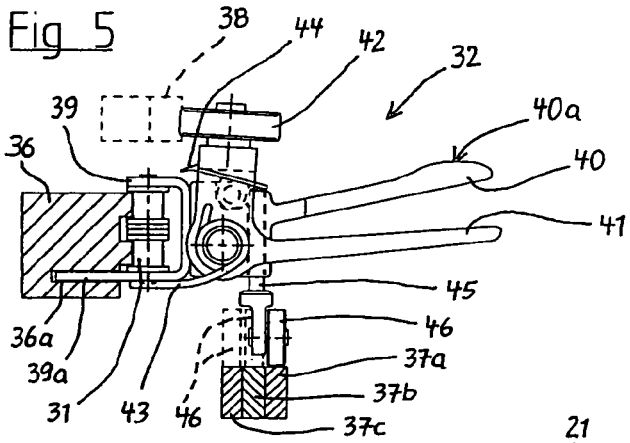
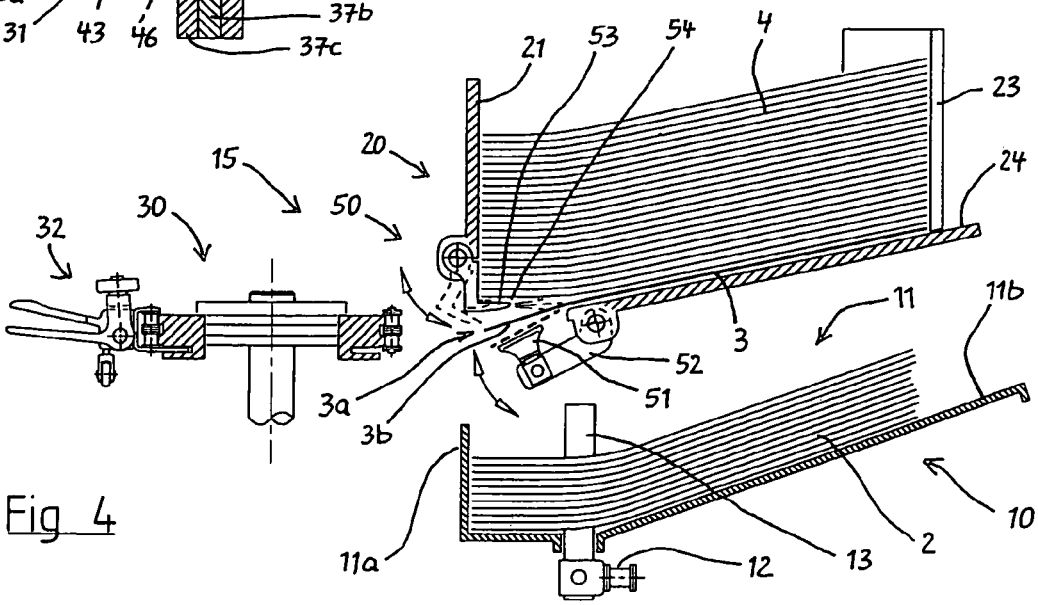
Fig 4

DEVICE FOR GATHERING SHEETS

BACKGROUND OF THE INVENTION

The invention pertains to a device for gathering printed sheets, particularly signatures and/or individual sheets.

During the gathering process in a book binding system, an individual signature is respectively withdrawn from several collections of identical signatures, wherein the various decollated signatures are delivered to a collecting conveyor in order to form stacks.

A gathering machine with feed stations according to the longitudinal withdrawal principle is known from DE 196 16 047 A1, wherein this gathering machine comprises a conveyor belt that carries a signature stack in a magazine such that a region of the folded edge remains exposed and respectively advances the bottom signature in a correspondingly cyclic fashion, as well as a withdrawal conveyor system that serves for receiving and additionally transporting the advanced signatures and is composed of acceleration rollers. Before the advance, the bottom signature is taken hold of by a suction element in the exposed region of the folded edge and tilted away from the signature stack. Blast air nozzles generate an air cushion between the tilted signature and the following signature. A clamping conveyor consisting of an upper and a lower conveyor belt is arranged downstream of the withdrawal conveyor system and inclined toward the collecting conveyor, wherein this clamping conveyor deposits the decollated signatures on the stack being formed with a synchronous transport movement upstream of a pusher of the collecting conveyor. The signatures decollated by the feeder stations are delivered to the collecting conveyor without a change of direction.

Another decollating device for feeding sheets in the longitudinal direction is known from EP 1 520 817 A1. The separating device for lifting the exposed edge region of the bottom signature off the signature stack and the transport element for delivering the signature are arranged in a combined fashion on a withdrawal unit. This withdrawal unit features a feed surface that extends along the exposed edge region and is provided with suction openings, wherein this feed surface lifts the exposed edge region off the signature stack by means of a rotational movement due to its rolling contact with the respective signature. Before the withdrawal unit feeds the signature to an additional conveyor for delivering the signature to the collecting conveyor in the form of a transport movement perpendicular to the separating movement, the edge region is fixed on the feed surface with the aid of pressing elements. The withdrawal unit with the magazine arranged thereon and the additional conveyor are arranged in a straight line and inclined toward the collecting conveyor in the transport direction such that the signature transported over the magazine bottom is delivered to the collecting conveyor in a straight fashion.

One disadvantage of these known decollating devices can be seen in that head-folded signatures cannot be decollated if they are stacked in the magazine such that the head side points rearward. The separating elements are unable to collectively lift the at least two sheet sections of the signature off the signature stack in the front region of the magazine such that an upper sheet section is held back on the retaining element of the magazine and the signature cannot be pushed out. The known decollating devices feature a plurality of successively arranged transport devices, wherein a few of these transport devices carry out intermittent or pendulum-type movements and therefore have a complicated design. The gathering capacity of known decollating devices is limited due to the fact that an ensuing decollating process can only be initiated once the preceding signature is completely withdrawn from the magazine.

SUMMARY OF THE INVENTION

The present invention is based on the objective of developing a device for gathering printed sheets, particularly signatures and/or individual sheets, that has a simple construction and allows a high processing speed. Another objective to be attained is the reliable decollating of head-folded signatures.

BRIEF DESCRIPTION OF THE DRAWING

Characteristics of the present invention are described in greater detail below with reference to one preferred embodiment that is illustrated in the enclosed figures. The respective figures show:

FIG. 3, a section through the magazine along the line III-III in FIG. 1;

FIG. 4, a section along the line IV-IV in FIG. 1, and

FIG. 5, the detail V of a gripper indicated in FIG. 3.

DESCRIPTION OF THE PREFERRED EMBODIMENT

Figure 1:
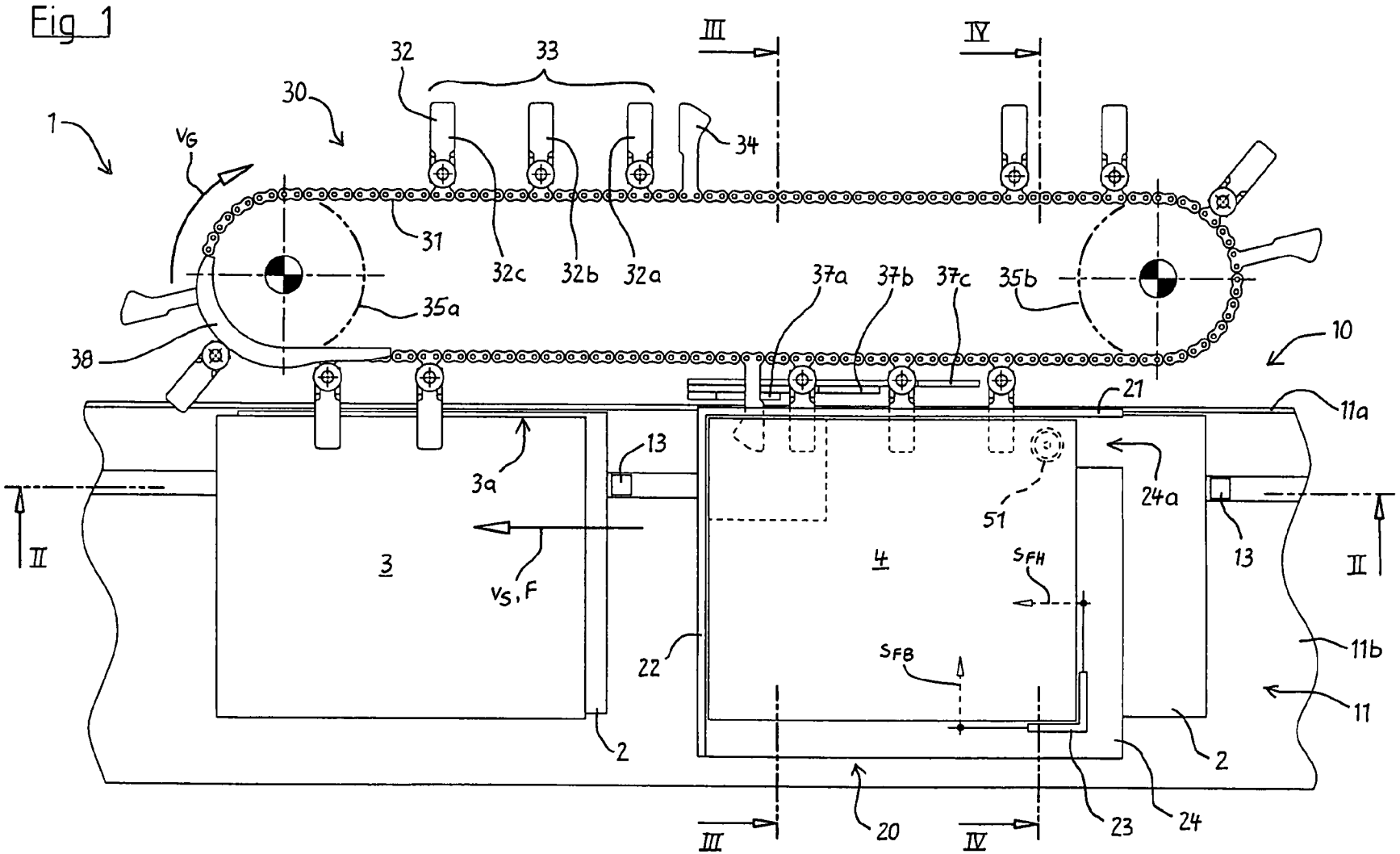
FIG. 1, a schematic top view of a gathering machine with a feeder station according to the invention.
Figure 2:
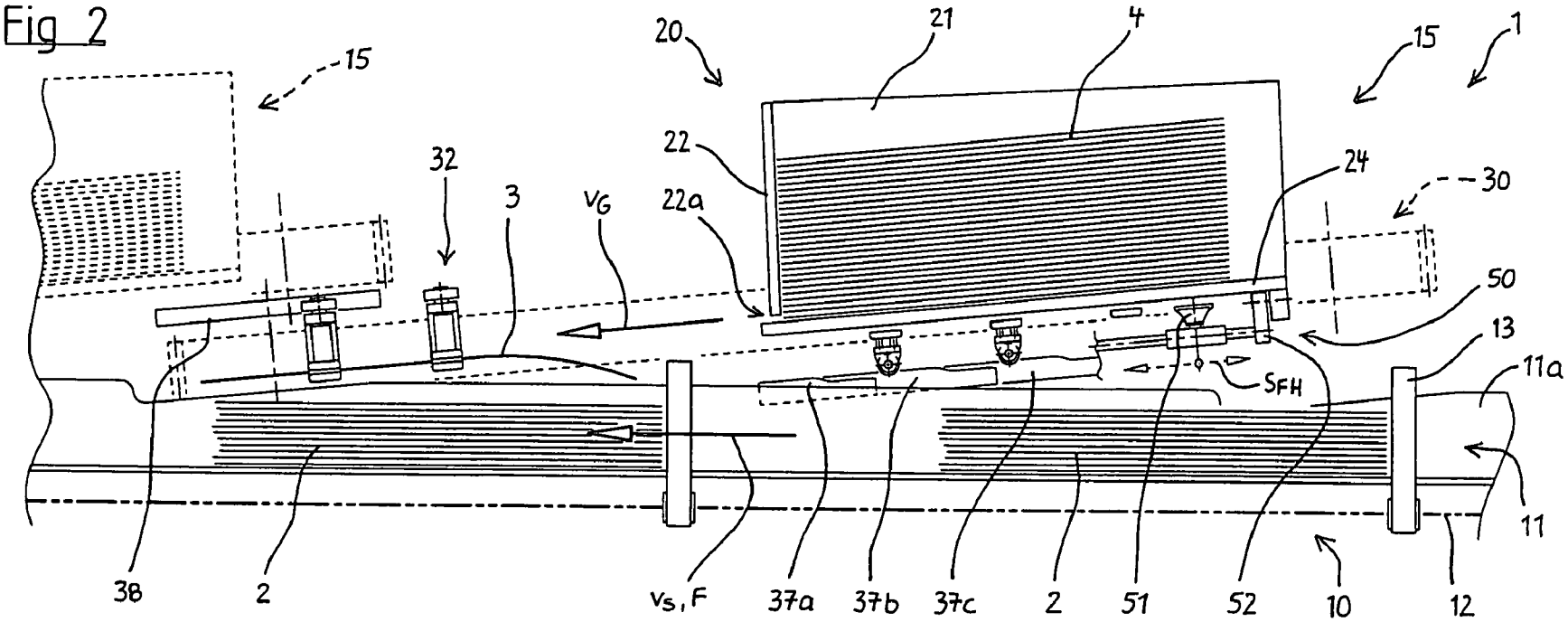
FIG. 2, a section through the gathering machine along the line II-II in FIG. 1.

FIGS. 1 and 2 show a gathering machine that is identified as a whole by the reference symbol 1 and essentially consists of a collecting conveyor 10 and several feeder stations 15 that are arranged in a row above the collecting conveyor. In each of these feeder stations 15, an individual signature 3 is respectively withdrawn from a stack 4 of identical signatures and delivered to the collecting conveyor 10 in order to form stacks. The collecting conveyor 10 is composed of a transport channel 11 with a vertical channel wall 11*a* and an inclined channel bottom 11*b* as well as a transport chain 12 that is driven in the (collecting) transport direction F with a continuous transport speed $v_S$ and features pushers 13 that are uniformly spaced apart from one another and push the book blocks being formed forward in the transport channel 11, wherein the spine 3*a* of the book block or the signature 3 adjoins the vertical channel wall 11*a*.

A feeder station 15 essentially consists of a magazine 20 for accommodating the signature stack 4, a separating device 50 for tilting away at least one corner of the bottom signature 3 lying in the magazine 20 and a gripper chain 30 that serves as the transport device for withdrawing the signature 3 from the magazine 20 and delivering the signature to the collecting conveyor 10.

The magazine bottom 24 of the magazine 20 is inclined toward the collecting conveyor in the transport direction F of the collecting conveyor 10, as well as inclined transverse to the transport direction F such that it descends toward the vertical channel wall 11*a*. Due to this inclined arrangement, the signature stack 4 respectively adjoins a lateral and a front magazine wall 21 and 22, wherein an additional guide in the form of an angled fence 23 is provided that can be adjusted with respect to the signature format. The adjusting means for the angled fence 23 are not illustrated in detail in the figures, but rather merely indicated with arrows $S_{FH}$ and $S_{FB}$ drawn with broken lines. The spine 3*a* of the signatures 3 adjoins the lateral magazine wall 21.

A recess 24*a* is provided in the magazine bottom 24 along the lateral magazine wall 21 such that an edge region 3*b* of the bottom signature 3 is exposed, wherein this edge region can be taken hold of by a suction element 51 of the separating device 50 and tilted relative to the remaining stack lying thereon. The suction element 51 is accommodated on a lever 52 that carries out a reciprocating pivoting movement in the corresponding cycle with the aid of not-shown driving means. The suction element 51 can be adjusted on the lever 52 ($S_{FH}$) with respect to the format height in order to enable the separating device to tilt the rear, upstream corner of the exposed edge region 3*b* of all signature formats.

The gripper chain 30 for withdrawing and transferring the bottom signature 3 features a traction mechanism in the form of a chain 31 that revolves around (deflection) chain wheels 35*a, b* and is continuously driven by a driving chain wheel 35 *a*, wherein several grippers 32 are anchored on said chain such that they are spaced apart from one another by defined distances, and wherein the special arrangement of the grippers results in the formation of several gripper sets 33 that respectively feature first, second and third grippers 32*a, b* and *c*. A separating wedge 34 is respectively anchored on the chain 31 upstream of the first gripper 32*a* and penetrates into the intermediate space between the tilted corner of the signature 3 and the signature stack 4 lying thereon in the corresponding cycle such that the exposed edge region 3*b* is completely lifted off the signature stack 4 as the penetration of the separating wedge progresses.

The edge region 3*b* is pulled down from a small shoulder 21*a* on the lateral magazine wall 21 that is offset in height referred to the magazine bottom 24. The signature stack 4 consequently lies in the magazine 20 in an angled fashion while the tilting of the exposed edge region 3*b* results in the bottom signature 3 being arranged in a leveled fashion for the withdrawal from the magazine 20. This supporting shoulder 21*a* could also be realized in the form of individual support needles. After lifting off the exposed edge region 3*a*, a stack lifter 53 that is pivoted into position in the corresponding cycle ensures that the signature stack 4 is securely supported, wherein a blast nozzle 54 arranged on the end of the stack lifter 53 generates an air cushion between the bottom signature 3 to be withdrawn and the signature lying thereon.

The grippers 32 that follow the separating wedge 34 move along the raised edge region 3*b* in the opened position, wherein an upper stationary gripper jaw 40 is situated in the intermediate space being formed. A lower gripper jaw 41 is movably received on the stationary gripper jaw 40 and prestressed by a torsion spring. The movable gripper jaw 41 is held in the open position against the force of said spring by means of a spring-loaded notch lever. The clamping process of the grippers 32*a, b, c* is triggered by actuating a trigger bolt. Additionally provided stationary closing cams 37*a, b* and *c* are arranged parallel to one another and act upon a cam roller 46 of the grippers 32*a, b* and *c* that is arranged on the trigger bolt 45 and correspondingly offset in a parallel fashion.

Since the closing cams 37*a, b* and *c* are offset in the transport direction F by the spacing between the grippers, all grippers 32*a, b* and *c* of a gripper set 33 are simultaneously closed. The distances between the grippers 32*a, b* and *c* are chosen such that a small format is taken hold of by at least two grippers 32*a* and *b* while a large format can be taken hold of by all three grippers 32*a, b, c*, wherein the distance between the first gripper 32*a* and the third gripper 32*c* is larger than half the format height of the signature 3. This means that the bottom signature 3 transported out of the magazine 20 through an opening 22*a* in the front magazine wall 22 can be withdrawn without being displaced.

The gripper chain 30 transports the signature 3 with a transport speed $v_G$ that is only slightly slower than the transport speed $v_S$ of the collecting conveyor 10. Due to the inclined arrangement of the gripper chain 30 parallel to the magazine 20, the signature 3 is withdrawn in a straight fashion over the magazine bottom 24 and delivered directly in front of the respective pusher 13 of the collecting conveyor 10. The opening of the grippers 32 results in a nearly synchronous transfer of the signatures 3 to the pushers 13, namely without having to drop the signatures 3 over a significant distance.

A stationary opening cam 38 is provided for opening the grippers 32, wherein the opening cam acts upon a cam roller 42 of the movable gripper jaw 41 and presses the movable gripper jaw away from the stationary gripper jaw 40 against its prestress until the notch lever 44 engages with the movable gripper jaw 41. The individual grippers 32*a, b, c* are opened successively such that the signature 3 to be transferred is transported by the gripper chain 30 as long as possible.

The design of a gripper 32 is shown in FIG. 5. The stationary gripper jaw 40 is fixed on a U-shaped bracket 39 of the chain 31, wherein the bracket 39 features an extension 39*a* that is guided in a groove 36*a* of a chain guide 36 such that it is prevented from turning. The gripper 32 is shown in its opened position. The prestressed gripper jaw 41 is held by the notch lever 44. The stationary gripper jaw 40 features a supporting surface 40*a* on its upper side for supporting the signature stack 4 while the grippers 32 pass through the magazine 20.

The feeder station 15 according to the invention is characterized in that it only comprises few moving components. The transport device in the form of a gripper chain 30 for withdrawing and transferring the signature 3, in particular, is simply realized in the form of a driven revolving conveyor, and the opening and closing of the grippers 32 is realized with the aid of stationary control cams 37*a, b, c* and 38. As soon as the rear corner of the next signature 3 is exposed during the withdrawal of a signature 3, the next decollating process can already begin by pivoting the suction element 51 into position. The signatures 3 therefore can be withdrawn from the signature stack 4 within minimal distances from one another or even in the form of a shingled arrangement.

The feeder station 15 according to the invention makes it possible, in particular, to process head-folded signatures 3 that are stacked in the magazine 20 such that their head side points rearward and therefore do not have a closed folded edge on the lateral magazine wall 21. The feeder station 15 may be utilized in the form of an exchangeable module in a flexibly equipped gathering machine 1.

The invention claimed is:

1. In a device for gathering printed sheets, with feeder stations that are arranged in a row and include a magazine for respectively accommodating a stack of identical decollated sheets having a bottom sheet with an exposed edge region extending in a longitudinal direction;

a separating device that tilts the exposed edge region of the respective bottom sheet away from the stack;

a transport device that withdraws the bottom sheet from the stack parallel to the longitudinal direction of the edge region; and with a collecting conveyor for gathered stacks that includes a collecting channel and a transport chain with pushers, to which the decollated sheets are delivered in order to form the gathered stacks;

the improvement comprising that:

the separating device has at least one suction element for tilting away at least one corner of the sheet; and the transport device for withdrawing the sheet is formed by a revolving traction conveyor;

with individually actuated grippers that are anchored at certain distances from one another wherein a withdrawn sheet is taken hold of at the exposed edge region with at least two grippers; and wherein the traction conveyor is inclined toward the collecting conveyor in order to deposit the withdrawn sheet on the stack being formed directly in front of the pusher of the collecting conveyor.

2. The device according to claim 1, wherein the suction element is arranged on an upstream corner of the stack.

3. The device according to claim 1, wherein the magazine is inclined such that it descends in the transport direction (F) of the collecting conveyor and the magazine bottom extends parallel to the traction conveyor.

4. The device according to claim 1, wherein at least two grippers can be actuated simultaneously in order to take hold of the tilted edge region.

5. The device according to claim 1, wherein the traction conveyor has several gripper sets that are respectively composed of a plurality of grippers that are uniformly spaced apart from one another, wherein one gripper set is respectively provided for taking hold of one sheet.

6. The device according to claim 5, wherein a separating wedge is arranged upstream of each gripper set and anchored on the traction means in order to completely lift off the edge region of the bottom sheet starting from the tilted corner.

7. The device according to claim 1, wherein the traction conveyor with the grippers is continuously driven.

8. The device according to claim 7, wherein the traction conveyor with the grippers can be driven with a nearly synchronous transport speed ($v_G$) relative to the collecting conveyor.

9. The device according to claim 1, wherein the grippers have a movable gripper jaw that this prestressed to take hold of the sheet and actuated by control cams to be opened and closed.

10. The device according to claim 9, wherein an opening cam is stationarily arranged on the delivery end of the traction conveyor and acts upon a cam roller of the movable gripper jaw.

11. The device according to claim 9, wherein the gripper has a locking mechanism for the opened position that comprises a trigger element and a trigger actuating surface which is offset relative to the moving path of the grippers of a gripper set such that the simultaneous closing of several grippers of a gripper set can be triggered by respectively associated closing cams.

12. The device according to claim 1, wherein the magazine is inclined transverse to the withdrawing or collecting transport direction (F) such that it descends toward the exposed edge region of the sheets.

13. The device according to claim 12, wherein a supporting shoulder is arranged on the lower end of the magazine wall such that it is offset in height relative to the inclined magazine bottom and supports the exposed edge region of the sheet stack at an angle relative to the magazine bottom.

14. The device according to claim 1, including a stack lifter that can be moved underneath the exposed edge region of the residual sheet stack and the end of which is a blast nozzle.

15. The device according to claim 2, wherein the magazine is inclined such that it descends in the transport direction (F) of the collecting conveyor and the magazine bottom extends parallel to the traction conveyor.

16. The device according to claim 2, wherein at least two grippers can be actuated simultaneously in order to take hold of the tilted edge region.

17. The device according to claim 3, wherein at least two grippers can be actuated simultaneously in order to take hold of the tilted edge region.

18. The device according to claim 2, wherein the traction conveyor has several gripper sets that are respectively composed of a plurality of grippers that are uniformly spaced apart from one another, wherein one gripper set is respectively provided for taking hold of one sheet.

19. The device according to claim 3, wherein the traction conveyor has several gripper sets that are respectively composed of a plurality of grippers that are uniformly spaced apart from one another, wherein one gripper set is respectively provided for taking hold of one sheet.

20. The device according to claim 4, wherein the traction conveyor has several gripper sets that are respectively composed of a plurality of grippers that are uniformly spaced apart from one another, wherein one gripper set is respectively provided for taking hold of one sheet.

* * * * *